US005400816A

United States Patent [19]

Gerstenberger

[11] Patent Number: 5,400,816

[45] Date of Patent: Mar. 28, 1995

[54] PILOT ACTUATED OVERRIDE MECHANISM FOR HOLDING VALVE

[75] Inventor: Gerald R. Gerstenberger, Bradenton, Fla.

[73] Assignee: Dana Corporation, Toledo, Ohio

[21] Appl. No.: 851,737

[22] Filed: Mar. 16, 1992

Related U.S. Application Data

[63] Continuation-in-part of Ser. No. 593,000, Oct. 5, 1990, abandoned.

[51] Int. Cl.[6] ..... F15B 13/043

[52] U.S. Cl. ..... 137/106; 91/420; 91/447; 137/599

[58] Field of Search ..... 91/420, 447; 137/106, 137/599

[56] References Cited

U.S. PATENT DOCUMENTS

| | | | |
|---|---|---|---|
| 3,274,902 | 9/1966 | Kleckner | 91/420 |
| 3,381,587 | 5/1968 | Parquet | 91/420 |
| 4,172,582 | 10/1979 | Bobnar | 91/420 X |
| 4,290,447 | 9/1981 | Knutson | 91/447 X |
| 4,466,336 | 8/1984 | Broome et al. | 91/420 |
| 4,538,644 | 9/1985 | Knutson et al. | 91/459 X |
| 4,569,273 | 2/1986 | Anderson et al. | 91/447 |
| 4,838,306 | 6/1989 | Horn et al. | 91/420 X |
| 5,081,904 | 1/1992 | Horn et al. | 91/420 X |

*Primary Examiner*—Gerald A. Michalsky
*Attorney, Agent, or Firm*—MacMillan, Sobanski & Todd

[57] ABSTRACT

A holding valve for use in a hydraulic operating system of a machine which is adapted to perform both lifting and digging functions is disclosed. The holding valve includes a conventional poppet assembly for modulating the rate at which hydraulic fluid flows from a hydraulic cylinder when the machine is used for lifting functions. The poppet assembly regulates the speed at which a heavy load can be lowered. The holding valve further includes a pilot actuated piston assembly which is operated only when the machine is used for digging functions. When so actuated, the piston assembly engages the poppet assembly and moves it to a fully opened position. In this fully opened position, the poppet assembly is prevented from modulating the flow rate of hydraulic fluid therethrough, effectively removing the holding valve from the hydraulic circuit. Consequently, hydraulic fluid can flow to and from the digging device without interference from the holding valve.

19 Claims, 4 Drawing Sheets

PILOT ACTUATED OVERRIDE MECHANISM FOR HOLDING VALVE

CROSS REFERENCE TO RELATED APPLICATION

This application is a continuation-in-part of application Ser. No. 07/593,000, filed Oct. 5, 1990, now abandoned.

BACKGROUND OF THE INVENTION

This invention relates in general to holding valves for hydraulically actuated devices and in particular to a pilot actuated override mechanism for such a holding valve.

Hydraulically operated machines are frequently used in construction projects and other activities. One commonly known hydraulically operated machine is the backhoe. Backhoes are used both for lifting loads upwardly above the ground and for digging downwardly into the ground. To accomplish this, backhoes are provided with articulated shovel assemblies which are moved by hydraulic operating systems. Such systems are provided with one or more valves which are manipulated by an operator to cause appropriate movement of the shovel assembly. For example, the shovel assembly can first be used to dig downwardly to excavate the soil where a pipeline is to be laid. Then, having removed the soil, the shovel assembly can be used to lower a length of pipe into the hole and to support it adjacent to a previously laid pipe so that the two pipes may be welded together.

The hydraulic operating systems of backhoes and similar machines typically include a source of pressurized fluid which is selectively connected to a cylinder containing a movable piston. The piston sealingly engages the inner surface of the cylinder, dividing it into first and second chambers. As is well known, by connecting the source to supply pressurized fluid to the first chamber and by simultaneously venting the second chamber, the piston can be moved in one direction relative to the cylinder. Conversely, by connecting the source to the second chamber and by venting the first chamber, the piston can be moved in the opposite direction relative to the cylinder. Lastly, by preventing fluid within both of the cylinder chambers from escaping therefrom, the piston can be locked in a predetermined position within the cylinder. The piston is connected by a rod to the movable member of the machine (i.e., the shovel assembly of a backhoe) for movement therewith.

In order to control the flow of pressurized fluid to and from the cylinder chambers, a control valve is usually connected between the source of pressurized fluid and the cylinder chambers. A conventional four-way valve is frequently employed for this purpose. The four-way valve usually has three operating positions. In its first position, the four-way valve connects the source of pressurized fluid to the first chamber and vents the second chamber, causing the piston to move in one direction. In its second position, the four-way valve connects the source of pressurized fluid to the second chamber and vents the first chamber, causing the piston to move in the opposite direction. In its third position, the four-way valve prevents fluid within both of the chambers from escaping therefrom, causing the piston to be locked in a predetermined position.

In most hydraulically operated machines which perform lifting functions, a holding valve is connected in the hydraulic lines extending between the four-way valve and the cylinder, typically directly adjacent to the cylinder. The holding valve is a well known device which performs several functions. First, the holding valve reliably seals the chambers of the cylinder when it is desired to maintain the load at an elevated position for a lengthy period of time, since the four-way valve is sometimes prone to leakage and consequent movement of the load. Second, the holding valve carefully modulates the rate at which hydraulic fluid flows from the cylinder chambers, thereby regulating the speed at which a heavy load is lowered. Third, the holding valve provides a static overload relief function, allowing excess pressurized fluid to escape from the system before causing damage. Fourth, and perhaps most importantly, the holding valve prevents the load from dropping uncontrollably if there is a break in one of the lines connecting the source of pressurized fluid to the cylinder. If this occurs, the holding valve prevents any hydraulic fluid from flowing in or out of the cylinder chambers, thereby locking the piston within the cylinder and preventing the load from falling.

Since most backhoes can perform both lifting and digging functions, their hydraulic operating systems are generally provided with holding valves for the reasons described above in connection with lifting machines. When the backhoe is used to perform a digging operation, however, there is little need for such a holding valve, since the shovel assembly is not raised a significant height above the ground. Unfortunately, when it is desired to use the shovel assembly to dig below ground level, the holding valve can have an undesirable effect on the operation thereof. The flow rate modulation of the hydraulic fluid flowing through the holding valve can limit the speed at which the shovel assembly is operated to dig into the ground. As a result, the shovel assembly may undesirably start and stop abruptly during use, as opposed to a preferable smooth motion. This is particularly so when an experienced backhoe operator attempts to move the shovel assembly rapidly through a digging cycle. Therefore, when the shovel assembly of a backhoe is operated in a digging cycle, it would be desirable to override the operation of the holding valve described above to permit a smoother digging motion to occur.

SUMMARY OF THE INVENTION

This invention relates to an improved holding valve for use in a hydraulic operating system of a machine which is adapted to perform both lifting and digging functions. The holding valve includes a conventional poppet assembly for modulating the rate at which hydraulic fluid flows from a hydraulic cylinder when the machine is used for lifting functions. The poppet assembly regulates the speed at which a heavy load can be lowered. The holding valve further includes a pilot actuated piston assembly which is operated only when the machine is used for digging functions. When so actuated, the piston assembly engages the poppet assembly and moves it to a fully opened position. In this fully opened position, the poppet assembly is prevented from modulating the flow rate of hydraulic fluid therethrough, effectively removing the holding valve from the hydraulic circuit. Consequently, hydraulic fluid can flow to and from the digging device without interference from the holding valve.

It is an object of this invention to provide an improved holding valve adapted for use in a hydraulic operating system of a machine which is adapted to perform both lifting and digging functions.

It is another object of this invention to provide such an improved holding valve with a pilot actuated piston assembly which can be selectively actuated to override the operation of the holding valve when the machine is used to perform digging functions.

It is a further object of this invention to provide such a holding valve which is simple and inexpensive in construction and operation.

Other objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
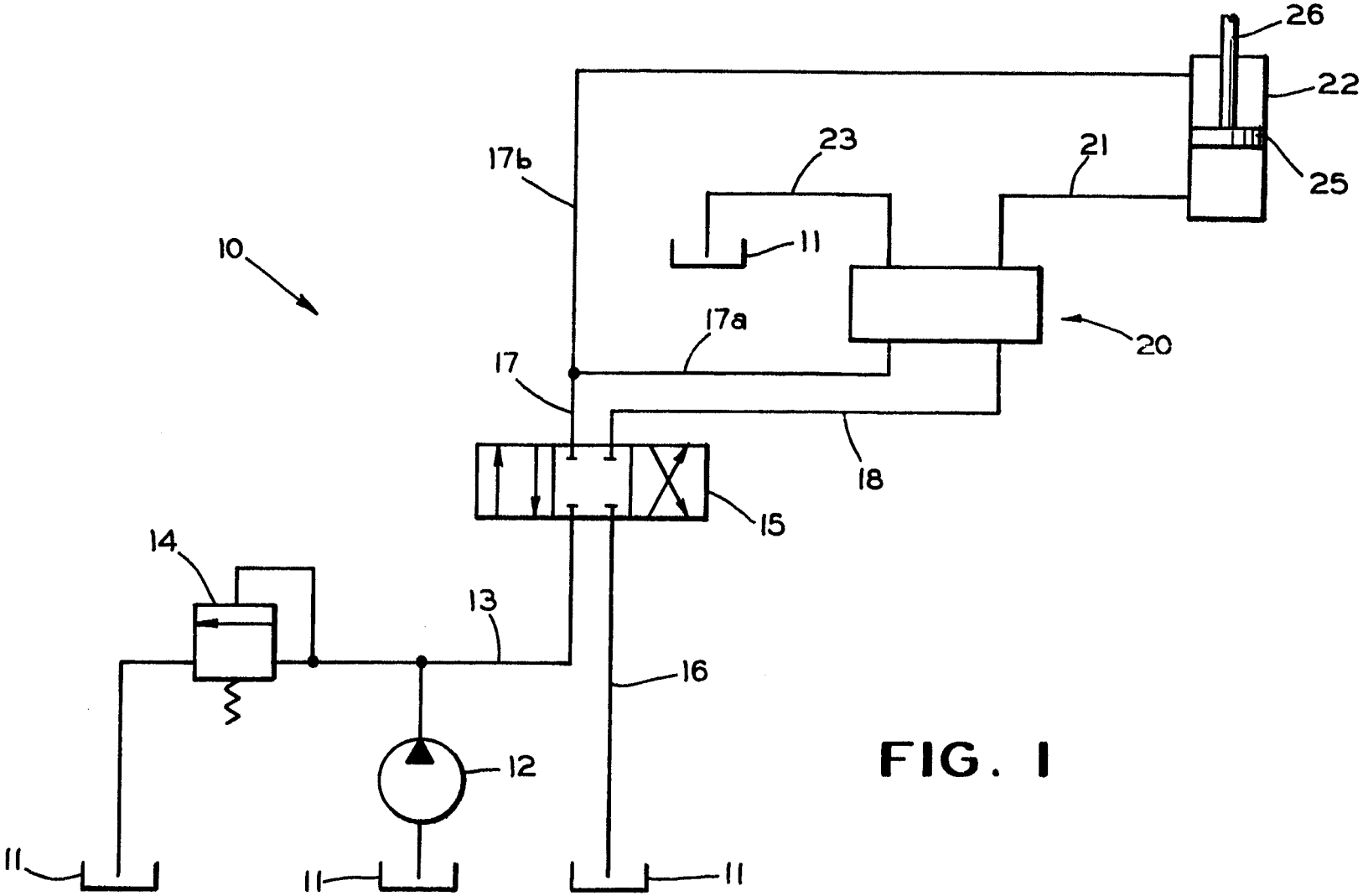
FIG. 1 is a schematic diagram of a hydraulic operating system for a machine having a movable member adapted to perform both lifting and digging functions, the system including an improved holding valve in accordance with this invention.

Referring now to the drawings, there is illustrated in FIG. 1 a schematic diagram of a hydraulic operating system, indicated generally at 10, such as might be used for operating a backhoe or similar machine. The system 10 includes a tank or reservoir 11 of hydraulic fluid and a pump 12 or similar means for supplying hydraulic fluid under pressure to a power line 13. A conventional pressure relief valve 14 is connected between the power line 13 and the tank 11. The power line 13 is connected to a first port of a conventional four-way control valve 15. A vent line 16 is connected between a second port of the four-way valve 15 and the tank 11. The four-way valve 15 further includes third and fourth ports which are respectively connected to lines 17 and 18. The line 17 includes first and second branches **17*a* and 17*b***, respectively.

A holding valve, indicated generally at 20, is provided in the system 10. The holding valve 20 has four ports, namely, a pilot port P, a valve port V, a cylinder port C, and a tank port T. The first branch **17*a* of the line 17 connects the third port of the four-way valve 15 to the pilot port P of the holding valve 20. The line 18 connects the fourth port of the four-way valve 15 to the valve port V of the holding valve 20. The cylinder port C of the holding valve 20 is connected through a line 21 to one side of a hydraulic cylinder 22. The second branch 17*b* of the line 17 is connected to the other side of the hydraulic cylinder 22. The tank port T of the holding valve 20 is connected through a line 23 to the tank 11**.

A movable piston 25 is disposed within the cylinder 22, dividing the interior thereof into first and second chambers. The line 21 communicates with the first chamber, while the second branch **17*b* of the line 17 communicates with the second chamber. A rod 26 is secured to the piston 25 for movement therewith. The rod 26 is connected to a movable member, such as the shovel assembly of a backhoe or similar machine, and extends outwardly from the cylinder 22. As is well known in the art, the four-way valve 15 is selectively moved so as to cause the piston 25 to move relative to the cylinder 22, thereby moving the member connected to the rod 26**.

Figure 2:
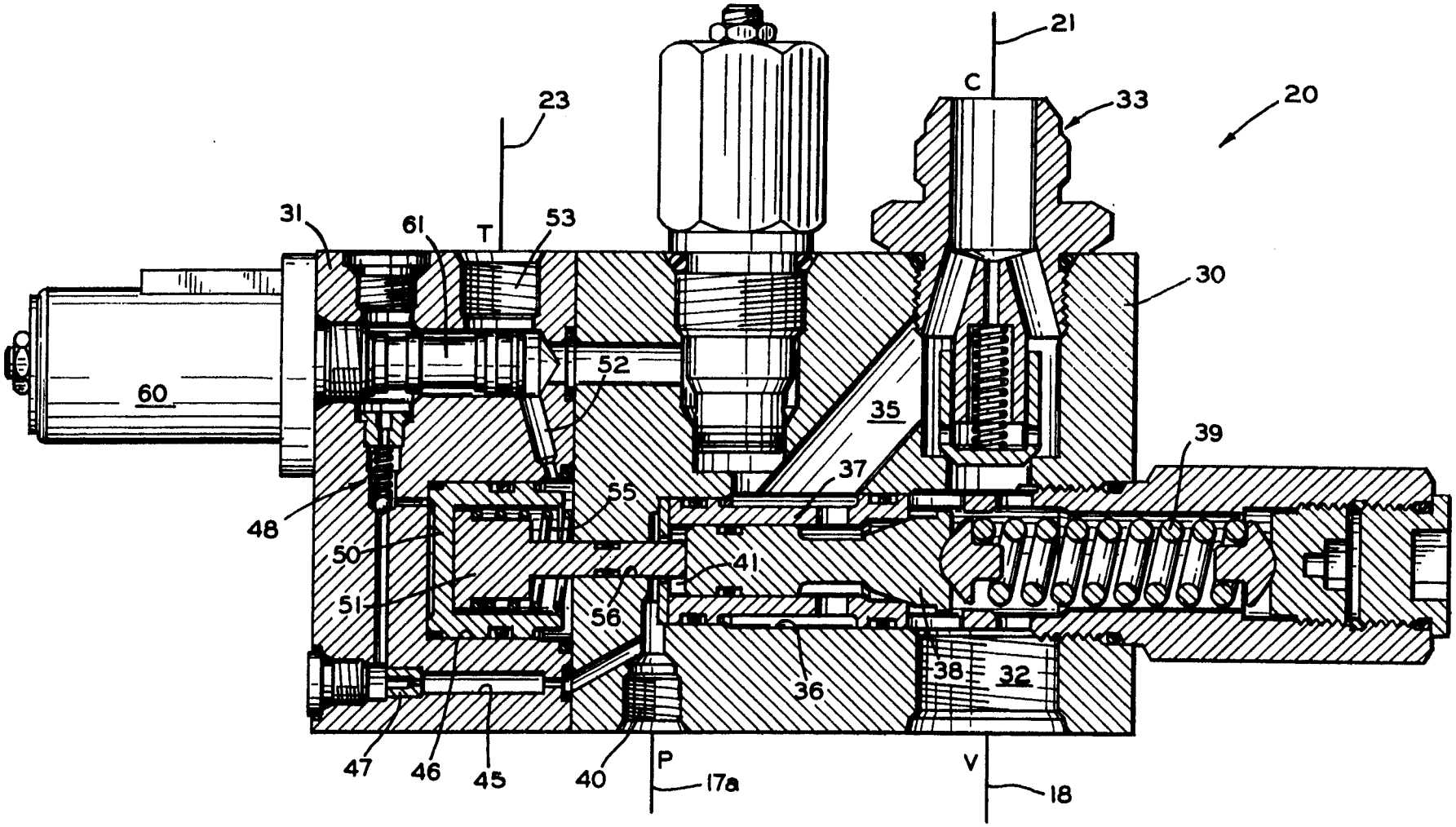
FIG. 2 is a sectional elevational view of the holding valve illustrated in FIG. 1, certain components of such holding valve being shown in respective first positions when the machine is used to perform lifting functions.
Figure 3:
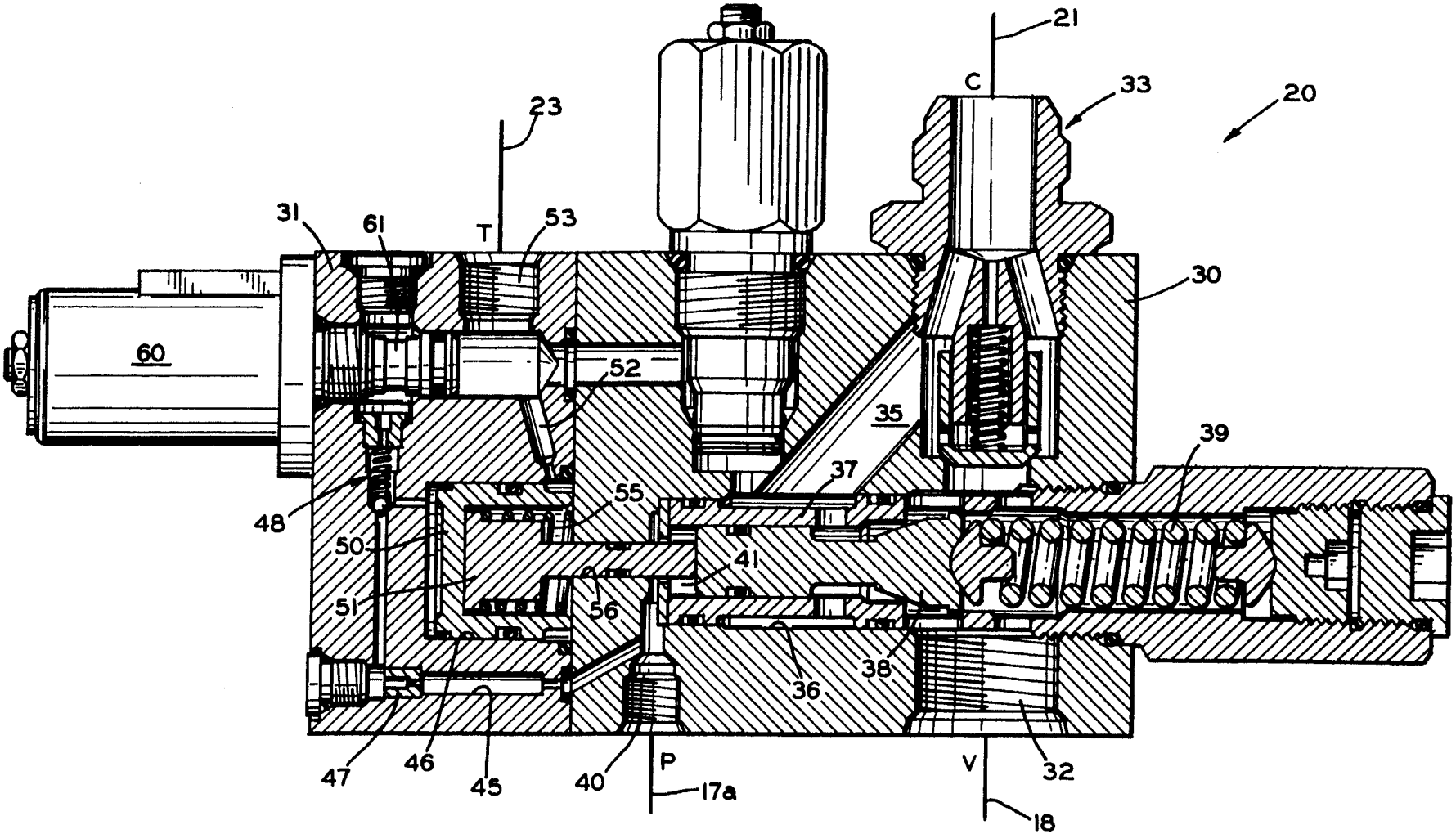
FIG. 3 is a sectional elevational view similar to FIG. 2 showing the components of the holding valve in respective second positions when the machine is used to perform digging functions.

Referring now to FIGS. 2 and 3, the structure of the holding valve 20 is illustrated in detail. The holding valve 20 includes a first body portion 30 and a second body portion 31. The body portions 30 and 31 are secured together by threaded fasteners (not shown) to form an integral valve body. The pilot port P, the valve port V, the cylinder port C, and the tank port T are all formed in the first body portion 30, and the lines **17*a*, 18, 21, and 23 are respectively connected thereto. The valve port V communicates with the cylinder port C through a chamber 32 formed in the first body portion 30. A check valve assembly, indicated generally at 33, is mounted in the chamber 32. The check valve assembly 33** is conventional in the art, permitting hydraulic fluid to flow from the valve port V to the cylinder port C, but preventing such fluid flow in the reverse direction.

The cylinder port C communicates through an angled passageway 35 with a chamber 36 formed in the first body portion 30. The chamber 36 communicates with the chamber 32. However, a hollow poppet housing 37 is retained within the chamber 36. Within the poppet housing 37, a poppet 38 is slidably disposed. A spring 39 is also disposed within the poppet housing 37. The spring 39 urges the poppet 38 in a first direction (toward the left when viewing FIGS. 2 and 3) into sealing engagement with a seat **37*a* (see FIG. 3) formed on the poppet housing 37. When the poppet 38 engages the seat 37*a* under the urging of the spring 39, fluid communication is prevented between the chamber 36 and the chamber 32. Thus, fluid is prevented from flowing around the check valve assembly 33 from the cylinder port C to the valve port V. Therefore, so long as the poppet 38 remains seated on the seat 37*a* of the poppet housing 37**, no hydraulic fluid is permitted to flow from the cylinder port C to the valve port V.

The pilot port P communicates through a passageway 40 with a small chamber 41 located adjacent the left end of the poppet 38. When pressurized hydraulic fluid is supplied to the pilot port P, pressure is exerted against the left end of the poppet 38 urging it against the urging of the spring 39 (toward the right when viewing FIGS. 2 and 3). When the magnitude of the pressure exerted by the hydraulic fluid against the left end of the poppet 38 exceeds the magnitude of the pressure exerted by the spring 39 against the right end of the poppet 38, the poppet 38 will move toward the right. As a result, the poppet 38 becomes unseated from the seat **37*a* formed on the poppet housing 37. Movement of the poppet 38** in this manner is accomplished to carefully modulate the rate at which hydraulic fluid flows from the cylinder port C to the valve port V.

The pilot port P also communicates through a passageway 45 with an internal chamber 46 formed in the second body portion 31 of the holding valve 20. An orifice plug 47 is disposed in the passageway 45 between the pilot port P and the chamber 46. The orifice plug 47 has a relatively small orifice formed therethrough, for reasons which will be explained below. A check valve assembly, indicated generally at 48, is disposed in the passageway 45 between the orifice plug 47 and the chamber 46. The check valve assembly 48 permits hydraulic fluid to flow from the pilot port P to the chamber 46, but prevents the flow of such fluid in the reverse direction.

A two-piece piston assembly is disposed in the chamber 46. The piston assembly includes a cup-shaped head portion 50 and an elongated T-shaped rod portion 51. The head portion 50 sealingly engages the wall of the chamber 46, dividing it into two sides. The passageway 45 from the pilot port P communicates with the first side of the chamber 46. The second side of the chamber 46 is vented through a passageway 52 to a chamber 53 which communicates with the tank port T. A spring 55 is disposed in the second side of the chamber 46. The spring 55 urges the rod portion 51 of the piston assembly against the head portion 50, thereby biasing the entire piston assembly in a first direction (toward the left when viewing FIGS. 2 and 3). However, when pressurized hydraulic fluid is supplied to the pilot port P, therefore, a pressure is exerted against the left end of the head portion 50 of the piston assembly, urging it against the urging of the spring 55 (toward the right when viewing FIGS. 2 and 3). When the magnitude of the pressure exerted by the hydraulic fluid against the left end of the head portion 50 exceeds the magnitude of the pressure exerted by the spring 55 against the rod portion 51, the entire piston assembly will move toward the right.

The rod portion 51 of the piston assembly extends through a bore 56 formed in the first body portion 30 and the chamber 41, terminating adjacent to the left end of the poppet 38. The length of the rod portion 51 is such that when the piston assembly is moved toward the left under the urging of the spring 55, the rod portion 51 does not engage the left end of the poppet 38. Consequently, the operation of the poppet 38 is unaffected by the rod portion 51. However, when the piston assembly is moved toward the right as described above against the urging of the spring 55, the rod portion 51 engages the left end of the poppet 38 and moves the poppet 38 toward the right against the urging of the spring 39.

The first side of the chamber 46 also communicates with the chamber 53 and, therefore, the tank port T. A solenoid actuated valve assembly, indicated generally at 60, is mounted on the second body portion 31 for selectively permitting such communication. The valve assembly 60 includes a movable armature 61 which extends into the chamber 53 and sealingly engages the inner surface thereof. The armature 61 is selectively movable between a first position (extended as shown in FIG. 2) and a second position (retracted as shown in FIG. 3). When the solenoid of the valve assembly 60 is energized, the armature 61 is moved to the extended position illustrated in FIG. 2. In this position, fluid communication between the first side of the chamber 46 and the chamber 53 is permitted. When the solenoid of the valve assembly 60 is de-energized, the armature 61 is moved to the retracted position illustrated in FIG. 3. In this position, fluid communication between the first side of the chamber 46 and the chamber 53 is prevented.

The operation of the system 10 and the holding valve 20 will now be described in detail. Assuming that the system 10 is to be used for digging purposes, the solenoid valve assembly 60 is de-energized. Thus, the armature 61 is retracted as shown in FIG. 3, blocking fluid communication between the chamber 46 and the chamber 53. To initially lift the shovel assembly to begin digging, the four-way valve 15 is moved to the left from the position illustrated in FIG. 1. Such movement connects the power line 13 to the line 18, thereby supplying pressurized fluid from the pump 12 to the valve port V. As shown in FIGS. 1 and 3, the pressurized fluid flows upwardly through the check valve assembly 33, the cylinder port C, and the line 21 to the first chamber of the cylinder 22.

At the same time, the line 17 is vented through the vent line 16 to the tank 11. Thus, both the pilot port P and the second chamber of the cylinder 22 are vented to the tank through the branches **17*a* and 17*b*, respectively. The venting of the pilot port P allows the spring 55 to move the piston assembly toward the left, out of engagement with the poppet 38. Similarly, the spring 39 is permitted to move the poppet 38 toward the left into sealing engagement with the seat 37*a* formed on the poppet housing 37. The venting of the second chamber of the cylinder 22 allows the piston 25 to move upwardly within the cylinder 22 because of the pressurized fluid now supplied to the first chamber of the cylinder 22**. Consequently, the shovel assembly is raised to begin digging.

To move the piston 26 (and the shovel assembly connected thereto) downwardly, the four-way valve 15 is then moved to the right from the position illustrated in FIG. 1. Such movement connects the power line 13 to the line 17, thereby supplying pressurized fluid from the pump 12 to both the pilot port P and the second chamber of the cylinder 22. The increased pressure at the pilot port P is exerted against both the left end of the poppet 38 and the left end of the head portion 50 of the piston assembly. Because of the large surface area of the head portion 50, the pressurized fluid causes the piston assembly to move to the right, as shown in FIG. 3. As a result, the right end of the rod portion 51 engages the left end of the poppet 38, moving it to the right against the urging of the spring 39. Thus, the poppet 38 becomes unseated from the poppet housing 37, permitting fluid to flow from the chamber 36 to the valve port V.

At the same time, the line 18 is vented through the vent line 13 to the tank 11. Hydraulic fluid is vented, therefore, from the first chamber of the cylinder 22 through the line 21, the cylinder port C, the angled passageway 35, the chamber 36, and the valve port V to the tank 11. Since pressurized fluid is also supplied through the branch **17*b* to the second chamber of the cylinder 22, the piston 25 is urged downwardly therein. Throughout this downwardly movement, the rod portion 51 of the piston assembly maintains the poppet 38 in a full open position, thereby preventing it from hindering the flow of hydraulic fluid from the first chamber of the cylinder 22 to the tank 11. Thus, it can be seen that the operation of the holding valve 20** is effectively overridden as the shovel assembly is raised and lowered for the purpose of digging.

Assuming now that the system 10 is to be used for lifting purposes, the solenoid actuated valve assembly 60 is now energized. Thus, the armature 61 is moved to the position shown in FIG. 2, permitting fluid communication between the chamber 46 and the chamber 53. To initially lift the shovel assembly to begin lifting, the four-way valve 15 is moved to the left from the position illustrated in FIG. 1. Such movement causes the piston 25 (and the shovel assembly connected thereto) to move upwardly within the cylinder 22 as described above.

To move the piston 26 downwardly, the four-way valve 15 is then moved to the right from the position illustrated in FIG. 1. Such movement connects the power line 13 to the line 17, thereby supplying pressurized fluid from the pump 12 to both the pilot port P and the second chamber of the cylinder 22. Hydraulic fluid flows through the passageway 45 into the chamber 46, but is vented through the chamber 53 to the tank 11. Therefore, the piston assembly remains in the position illustrated in FIG. 2 under the urging of the spring 55, out of engagement with the poppet 38.

Hydraulic fluid also flows through the passageway 40 into the chamber 41. The pressure in the chamber 41 rises quickly because of the orifice plug 47 located in the passageway 45. The orifice formed through the orifice plug 47 is sized to be relatively small in comparison to the amount of hydraulic fluid being supplied into the pilot port P by the pump 12. Therefore, the hydraulic fluid in the chamber 41 causes the poppet 38 to move slightly in opposition to the urging of the spring 39. In this manner, the movement of the poppet 38 modulates the flow of fluid from the first chamber of the cylinder 22 through the line 21, the cylinder port C, the angled passageway 35, the chamber 36, and the valve port V to the tank 11. Thus, it can be seen that the holding valve 20 operates in a conventional manner when the solenoid actuated valve assembly 60 is energized and the shovel assembly is raised and lowered for the purpose of lifting above the ground.

Figure 4:
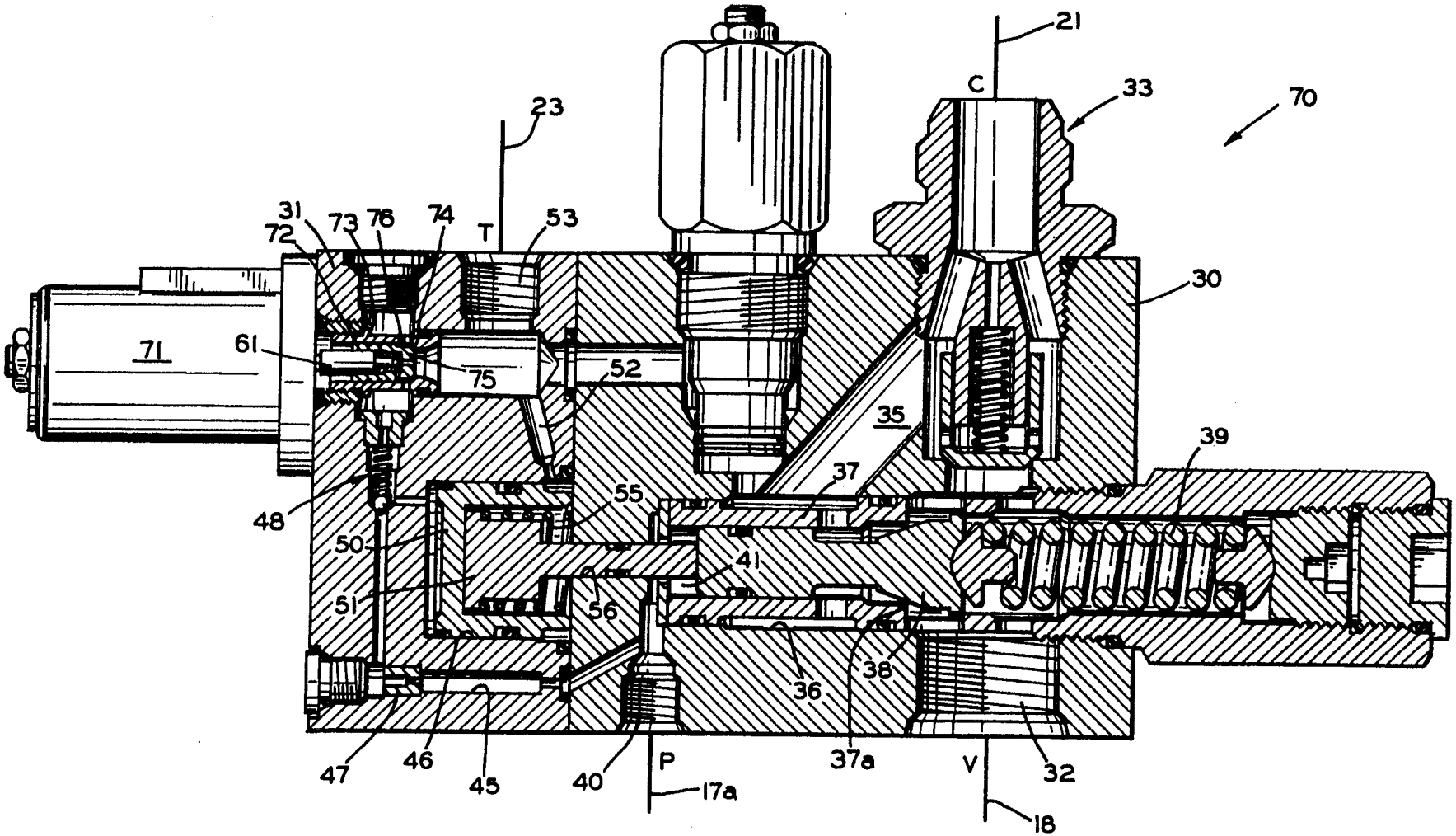
FIG. 4 is a sectional elevational view of an alternate embodiment of the holding valve illustrated in FIG. 2.

Referring now to FIG. 4, there is illustrated an alternate embodiment of a holding valve, indicated generally at 70, in accordance with this invention. The holding valve 70 includes a solenoid actuated poppet valve assembly 71 which can be used in place of the solenoid actuated valve assembly 60 shown in FIGS. 2 and 3. The poppet valve assembly 71 includes a poppet 72 which is slidably disposed within a hollow cylindrical poppet housing 73. The poppet 72 is resiliently engaged for movement with the solenoid armature 61. When the solenoid is energized, the armature 61 is extended, urging the poppet 72 into sealing engagement with a valve seat 74 formed on the inner surface of the poppet housing 73. When the poppet 72 engages the valve seat 74, fluid communication between the front side of the chamber 46 and the chamber 53 is prevented.

The poppet 72 includes a reduced diameter end portion 75 defining an annular shoulder 76. The fluid in the front side of chamber 46 can flow through the check valve 48 to the shoulder 76. The fluid exerts a force upon the shoulder 76 to urge the poppet 72 away from the valve seat 74. The shoulder 76 is sized such that the fluid force against the shoulder 76 is less than the force exerted by the energized solenoid. This assures closure of the poppet valve assembly 71. However, when the solenoid is de-energized, the armature 61 is retracted. As a result, the fluid force exerted upon the poppet shoulder 76 is sufficient to open the poppet valve assembly 71. Opening the poppet valve assembly 71 establishes fluid communication between the front side of the chamber 46 and the chamber 53. Thus, the poppet valve assembly 71 is open when the solenoid is deenergized and closed when the solenoid is energized. This is the opposite from the functioning of the solenoid actuated valve assembly 60 illustrated in FIGS. 2 and 3. Otherwise, this embodiment functions the same as the previously described embodiment.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A holding valve assembly for use in a hydraulic operating system, the assembly having a valve port adapted to receive fluid from and deliver fluid to a control valve, a cylinder port adapted to receive fluid from and deliver fluid to a fluid actuator, a pilot port adapted to receive pilot fluid from and deliver pilot fluid to the control valve, and a tank port adapted to deliver fluid to a reservoir, said holding valve assembly comprising:

a primary check valve assembly for permitting fluid to flow in a first direction from the valve port to the cylinder port of the holding valve assembly;

a poppet valve assembly for permitting fluid to flow in a second direction from the cylinder port to the valve port of the holding valve assembly, said poppet valve assembly having a closed position for preventing fluid from flowing therethrough, an open position for permitting fluid to flow therethrough, and intermediate positions for modulating the rate at which fluid flows therethrough, the selection of which being determined by pilot fluid pressure communicated through a first passage in the holding valve assembly from the holding valve pilot port to said poppet valve assembly;

means for opening and holding open said poppet valve assembly, said means actuated by pilot fluid pressure communicated through a second passage in the holding valve assembly, said second passage connecting said holding valve pilot port to said means, said means for opening and holding open said poppet including a piston assembly which is selectively actuated to engage said poppet valve assembly and move said poppet valve assembly to an open position, said piston assembly being moved by pilot fluid pressure communicated through a passage in the holding valve assembly, said passage connecting said .piston assembly to the holding valve pilot port; and a secondary check valve assembly which closes said passage connecting said piston assembly to the holding valve pilot port, so that said piston assembly retains said poppet valve assembly in the open position.

2. The invention defined in claim 1 wherein a valve closes and opens a fluid passage connecting said piston assembly to the holding valve tank port, so that pilot fluid pressure is selectively applied to said piston assembly.

3. The invention defined in claim 2 wherein said valve used to close and open said fluid passage is actuated by a solenoid.

4. The invention defined in claim 1 wherein said pilot actuated piston assembly includes:

a slidable cup shaped head assembly;

a T-shaped rod portion having first and second ends, said first end being in contact with the interior of said head assembly, and said second end being in communication with one end of said poppet valve, said poppet valve being displaced in response to movement of said T-shaped rod portion; and, a spring which engages said T-shaped portion and urges said T-shaped portion against said cup shaped head assembly.

5. The invention defined in claim 1 wherein an orifice device restricts the flow of pilot fluid through said passage in the holding valve assembly connecting said piston assembly to the holding valve pilot port.

6. A holding valve assembly for use in a hydraulic operating system, the assembly having a valve port adapted to receive fluid from and deliver fluid to a control valve, a cylinder port adapted to receive fluid from and deliver fluid to a fluid actuator, a pilot port adapted to receive pilot fluid from and deliver pilot fluid to the control valve, and a tank port adapted to deliver fluid to a reservoir, comprising:

a primary check valve assembly for permitting fluid to flow in a first direction from the valve port to the cylinder port of the holding valve assembly;

a poppet valve assembly for permitting fluid to flow in a second direction from the cylinder port to the valve port of the holding valve assembly, said poppet valve assembly having a closed position for preventing fluid from flowing therethrough, an open position for permitting fluid to flow therethrough, and intermediate positions for modulating the rate at which fluid flows therethrough, the selection of which being determined by pilot fluid pressure communicated through a passage in the holding valve assembly from the holding valve pilot port to said poppet valve assembly;

a piston assembly which is moved by pilot fluid pressure, communicated through a passage connecting said piston assembly to the holding valve pilot port, to engage said poppet valve assembly and move said poppet valve assembly to an open position;

a secondary check valve assembly which closes said passage connecting said piston assembly to the holding valve pilot port, so that said piston assembly retains said poppet valve assembly in the open position;

a valve which closes and opens a fluid passage connecting said piston assembly to the holding valve tank port, so that pilot fluid pressure is selectively applied to said piston assembly; and, an orifice device which restricts the flow of pilot fluid through said passage in the holding valve assembly connecting said piston assembly to the holding valve pilot port.

7. The invention defined in claim 6 wherein said pilot actuated piston assembly includes:

a slidable cup shaped head assembly;

a T-shaped rod portion having first and second ends, said first end being in contact with the interior of said head assembly, and said second end being in communication with one end of said poppet valve, said poppet valve being displaced in response to movement of said T-shaped rod portion; and, a spring which engages said T-shaped portion and urges said T-shaped portion against said cup shaped head assembly.

8. The invention defined in claim 6 wherein said valve used to close and open said fluid passage connecting said piston assembly to the holding valve tank port is actuated by a solenoid.

9. A holding valve assembly adapted for use in a hydraulic operating system comprising:

a body having a valve port adapted to communicate with a control valve, a cylinder port adapted to communicate with a fluid actuator, a pilot port adapted to communicate with the control valve, and a tank port adapted to communicate with a reservoir;

means for permitting the one-way flow of fluid from said valve port to said cylinder port;

means for selectively permitting the one-way flow of fluid from said cylinder port to said valve port, said means for selectively permitting including a poppet valve assembly disposed within said body and movable between a closed position, wherein the flow of fluid from said cylinder port to said valve port is prevented, and an opened position, wherein the flow of fluid from said cylinder port to said valve port is permitted, the operation of said poppet valve assembly being normally controlled in response to the pressure of the fluid at said pilot port; and means for selectively maintaining said poppet valve assembly in said opened position regardless of the pressure of the fluid at said pilot port.

10. The invention defined in claim 9 wherein said means for permitting the one-way flow of fluid from said valve port to said cylinder port includes a passageway having a check valve disposed therein.

11. The invention defined in claim 9 wherein said means for selectively maintaining said poppet valve assembly in said opened position includes a piston assembly which is movable between a first position, wherein said piston assembly is not engaged with said poppet valve assembly so as to allow the free movement thereof, and a second position, wherein said piston assembly engages said poppet valve assembly to move said poppet valve assembly to said opened position.

12. The invention defined in claim 11 further including means for selectively moving said piston assembly between said first and second positions.

13. The invention defined in claim 12 wherein said means for selectively moving said piston assembly includes a passageway communicating with said pilot port and means for selectively venting said passageway to said tank port.

14. The invention defined in claim 13 wherein said means for selectively venting said passageway to said tank port includes a check valve which permits the one-way flow of fluid from said passageway to a chamber communicating with said tank port and means for selectively preventing fluid communication between said check valve and said chamber.

15. The invention defined in claim 14 wherein means for selectively preventing fluid communication between said check valve and said chamber includes an armature which is movable between a first position, wherein fluid communication is permitted between said check valve and said chamber, and a second position, wherein fluid communication is prevented between said check valve and said chamber.

16. The invention defined in claim 15 further including means for moving said armature between said first and second positions.

17. The invention defined in claim 16 wherein said means for moving said armature between said first and second positions includes a solenoid actuator.

18. The invention defined in claim 11 wherein said piston assembly includes a head portion and a rod portion separate from said head portion, said rod portion having first and second ends, said first end of said rod portion being engaged with said head portion, said second end of said rod portion engaging said poppet valve assembly.

19. The invention defined in claim 18 further including means for urging said rod portion of said piston assembly into engagement with said head portion thereof.

* * * * *